US007020291B2

(12) United States Patent
Buck et al.

(10) Patent No.: US 7,020,291 B2
(45) Date of Patent: Mar. 28, 2006

(54) NOISE REDUCTION METHOD WITH SELF-CONTROLLING INTERFERENCE FREQUENCY

(75) Inventors: Markus Buck, Zwiefaltendorf (DE); Tim Haulick, Blaustein (DE); Klaus Linhard, Schelklingen (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 489 days.

(21) Appl. No.: 10/121,180

(22) Filed: Apr. 12, 2002

(65) Prior Publication Data

US 2002/0176589 A1 Nov. 28, 2002

(30) Foreign Application Priority Data

Apr. 14, 2001 (DE) ..... 101 18 653

(51) Int. Cl.
*H04R 3/00* (2006.01)

(52) U.S. Cl. ..... 381/92; 381/94.7; 381/94.3

(58) Field of Classification Search ..... 381/94.1, 381/94.7, 92, 71.1, 94.2, 94.3; 704/226, 704/233

See application file for complete search history.

(56) References Cited

U.S. PATENT DOCUMENTS 5,479,517 A 12/1995 Linhard ..... 381/94
5,574,824 A * 11/1996 Slyh et al. ..... 704/226
5,754,665 A * 5/1998 Hosoi ..... 381/94.1
6,339,758 B1 * 1/2002 Kanazawa et al. ..... 704/226
6,717,991 B1 * 4/2004 Gustafsson et al. ..... 381/71.1

FOREIGN PATENT DOCUMENTS

DE 4307688 9/1994
EP 0615226 9/1994

OTHER PUBLICATIONS

Boll, S F, "Suppression of acoustic noise in speech using spectral subtraction", IEEE Transactions on Acoustics, speech and signal processing, IEEE Inc, New York, USA, vol. 27, Nr. 2, Apr. 1979, ISSN 0096-3518.

* cited by examiner

*Primary Examiner*—Brian T. Pendleton
(74) *Attorney, Agent, or Firm*—Davidson, Davidson & Kappel, LLC

(57) ABSTRACT

The present invention relates to a method with which speech is captured in a noisy environment with as high a speech quality as possible. To this end, a compact array of, for example, two single microphones is combined to form one system through signal processing methods consisting of adaptive beam formation and spectral subtraction. Through the combination with a spectral subtraction, the reference signal of the beam former is freed from speech signal components to the extent that a reference signal of the interference is formed and the beam former produces high gains.

9 Claims, 3 Drawing Sheets

NOISE REDUCTION METHOD WITH SELF-CONTROLLING INTERFERENCE FREQUENCY

Priority to German Patent Application No. 101 18 653.3-53, filed Apr. 14, 2001 and incorporated by reference herein, is claimed.

BACKGROUND INFORMATION

The present invention relates generally to a noise reduction method.

A frequently used noise reduction method for a disturbed useful signal such as a voice signal, music signal, etc., is spectral subtraction. An advantage of spectral subtraction is the low complexity and that the disturbed useful signal is needed only in one variant (only one channel). A disadvantage consists in the signal delay (caused by the block processing in the spectral domain), the limited maximum attainable noise reduction, and the difficulty in compensating for transient noise. Stationary noise can be reduced, for example, by 12 dB, with the speech still having good quality.

If a higher noise reduction or better speech quality are desired, several recording channels are required. One uses, for example, microphone arrays. Those of the different microphone arrays which make do with small geometrical dimensions for the microphone arrangement are of special interest for many practical applications. Small differential microphone arrays (also referred to as superdirective arrays) are configured as well as an adaptive variant of this microphone arrangement, the LMS (least mean square) algorithm being used for adaptation. In the case of the adaptive form of this array, two microphones are subtracted in two ways with propagation time compensation so as to produce a 'virtual' microphone with cardioid or kidney-shaped characteristic toward the speaker and a 'virtual' microphone with cardioid characteristic facing away from the speaker. The propagation time compensation corresponds to the time required by the sound for the distance between the two microphones, for example, 1.5 cm. A "back-against-back" cardioid characteristic ensues. The microphone which is directed toward the speaker is the primary signal for the adaptive filter and the microphone directed in the opposite direction is the reference signal of the interference.

FIG. 1 shows an adaptive arrangement for a beam former. The propagation time compensation with an all-pass filter ALL is accomplished by a shift by whole sampled values. The above described combination of two single microphones with omnidirectional characteristic produces a cardioid characteristic toward the speaker and a cardioid characteristic directed in the opposite direction as interference reference. Adaptive filter H1 is adapted in the time domain using the LMS (least mean square) algorithm. A low-pass filter TP at the system output emphasizes low frequency components which are attenuated when the cardioid characteristic is formed.

The tandem arrangement of microphones M according to FIG. 1 is referred to as end fire array whereas the side-by-side arrangement of the microphones is denoted by broadside array.

FIG. 2 shows an arrangement for a broadside array composed of two spaced microphones, the two microphone signals being pre-processed by spectral subtraction (SPS). A propagation time compensation between the two channels is carried out via all-pass filter All and serves to compensate for movements of the speaker. The sum of the two preprocessed microphone signals constitutes the primary input and the difference is the reference input for an adaptive filter H1. The adaptive filter in this arrangement with sum and difference input is also referred to as 'generalized sidelobe canceller'. The adaptation is carried out using the LMS algorithm, the LMS being implemented in the frequency domain. The microphone signals are post-processed using a modified cross-correlation function in the frequency domain. The fundamental structure including spectral pre-processing via SPS, beam formation, and post-processing (post) is described in European Patent EP 0615226B1, hereby incorporated by reference herein, without exactly specifying the beam former.

FIG. 3 is an overview of microphone circuitry arrangement for the formation of the directivity characteristics for two microphones. The two single microphones themselves can already have a cardioid characteristic or the so-called "omnidirectional characteristic". "ALL" denotes an all-pass filter for propagation time compensation. 'Gain' is a gain compensation between the two channels which is necessary in practice to equalize the sensitivity of the microphone capsules.

The direction of maximum sensitivity in the polar diagrams of the directivity characteristics is 90°. The first 3 arrangements a, b, and c, are suitable as speech channel since a maximum exists at 90° and an attenuation exists for the other directions. Arrangements a and b produce the same directivity characteristic. Arrangements a, b are referred to as sum or difference array and arrangement c is denoted as differential array. Arrangements d and e have a null at 90° in the polar diagram, and are therefore suitable as interference reference. The null at 90° in the polar diagram is necessary to prevent speech components from getting into the reference channel. Speech components in the reference channel lead to partial compensation of speech.

According to arrangements d and e in FIG. 3, a null will occur for the interference reference in the direction toward the speaker under ideal conditions. In practical applications, however, this will not be the case. As a result of this, speech components are treated as interference signals and, consequently, are removed from the actual speech signal.

Beam formers are usually adapted only during speech pauses in order not to permit adaptation to speech components. In this case too, however, speech components present in the reference are compensated for because they are always superimposed on the noise.

Another procedure is to equalize the gain of channels so that, in the ideal case, a null ensues after their subtraction. This is necessary because mass-produced microphones have tolerances. In the arrangements of FIG. 3, this is allowed for by the functional block 'gain' which equalizes different microphone sensitivities.

In applications, however, no null is adjusted for the speech signal in the reference in spite of the sensitivity compensation with 'gain'. Only under the condition that the microphone is operated in the acoustic free-field (without reflections), it is possible for the speech components to be completely compensated for. Real applications have a certain sound component from different directions due to reflections, preventing the occurrence of a null for the speech signal. In the case of arrangements according to FIG. 1 or FIG. 2, a certain speech component will always be found in the reference signal of the beam former, resulting in speech distortions.

SUMMARY OF THE INVENTION

An object of the present invention is to specify a noise reduction method which minimizes crosstalk of the useful signal into the interference reference signal.

The present invention provides a noise reduction method in which a reference signal of the interference is produced for multi-channel interference compensation systems, wherein the component of the useful signal which is unwanted in the reference signal is minimized in such a manner that the interference of the useful signal is reduced in at least one channel via a spectral subtraction, that the useful signal is carried in a further channel, and that at least one interference reference signal is produced by subtraction of the two channels.

The primary useful signal preferably is connected as a differential array (DA) of two channels (1, 2), or as a sum and difference array (DA) of two channels (1, 2).

The interference reference signal with the additional extension of the unilateral spectral subtraction in differential form may be produced in such a manner that the difference of the interference-suppressed useful signal from channel (1) and the useful signal from a further channel (2) is applied to an adaptive filter (H1); and that the filtered interference reference signal (R) is subsequently subtracted from the primary useful signal (P).

A spectral subtraction ($SPS_1$) may be carried out on a first channel (1) for the useful signal and, together with the useful signal in a second channel (2), is applied to an adaptive filter (H1), and a first reference signal (R1) is produced; a further spectral subtraction ($SPS_2$) being carried out on the useful signal of the second channel (2) and, together with the useful signal from the first channel (1), being applied to an adaptive filter (H2) in a further channel (3). A second reference signal (R2) may be formed and the two reference signals (R1, R2) subtracted from the primary useful signal (P).

The filters (H1, H2) may be adapted in the time domain or in the frequency domain using the LMS algorithm.

The useful signal preferably is recorded by microphones, and may be a speech signal.

The spectral subtraction may be continuously adjusted in its effectiveness via a parameter, and the parameter may be generated as the minimum value of a filter coefficient of the spectral subtraction at each frequency index. In the case of more than two input signals, a spectral subtraction for producing a reference signal may be carried out through combination of two inputs at a time.

The present invention has the advantage that markedly less useful signal components, such as speech components, are present in the interference reference signal than with the previous methods. It is thus possible for the interfering speech components to be eliminated under real conditions with speech signal reflections in real rooms as, for example, in the motor vehicle.

As a starting point of the present invention, a unilateral spectral subtraction is carried out to produce the interference reference signal. It is essential that the spectral subtraction for producing a reference signal be carried out only on one channel, which is denoted by 'unilateral' as used herein. Consequently, one channel contains useful and interference signals, and another channel contains only useful signals after the spectral subtraction. Upon the subsequent subtraction of the useful signal channel from the useful and intereference signal channel, the useful component is subtracted so that the interference remains. This difference is the interference reference signal.

If, for instance, microphones are used for recording speech signals, then the speech signals are processed in such a manner that the interference reference signal has a null toward the speaker in the form of a cardioid or eight-shaped characteristic. The unilateral spectral subtraction causes the characteristic to automatically regulate itself in such a manner that the null occurs only during speech activity. In speech pauses, the unilateral spectral subtraction results in that nothing or only a small signal is subtracted and that, consequently, the approximate characteristic of the single microphone (for example, cardioid or omnidirectional) is available for the interference.

The ideal null for the speech signal in the reference is only achieved with an ideal spectral subtraction in the acoustic free-field. An ideal spectral subtraction produces the interference-suppressed speech signal as the output signal and would then eliminate the need for any further processing. In practice, spectral subtraction produces only a good approximation of the speech signal with residual noise during the speech pauses. Since the unilateral spectral subtraction is used in addition to the microphone null, the speech components of the reference are markedly reduced.

The residual noise of the spectral subtraction during speech pauses is adjusted via a parameter, the 'spectral floor'. Spectral floor b is the minimum value of a filter coefficient W of the spectral subtraction at each frequency index i. Output signal Y(i) is produced by multiplying filter coefficients W(i) by input value X(i):

$$W(i):=\max(W(i),b);$$

and $$Y(i)=W(i)\cdot X(i);$$

The maximum value for W is 1 (output=input). When the selection b=1 is made, the spectral subtraction is virtually switched off. With b=0, the spectral subtraction reaches maximum effectiveness. In practice, poor speech quality results when b=0. Parameter b makes it possible for the present invention to continuously adjust the unilateral spectral subtraction in its effectiveness. With a value of, for example, b=0.25, a noise suppression of about 12 dB and a good speech quality are achieved.

BRIEF DESCRIPTION OF THE DRAWINGS

FIG. 4 shows 3 block diagrams with unilateral spectral subtraction for the reference input.

FIG. 5 shows an embodiment according to the present invention in which two reference signals are used.

DETAILED DESCRIPTION

Figure 4:
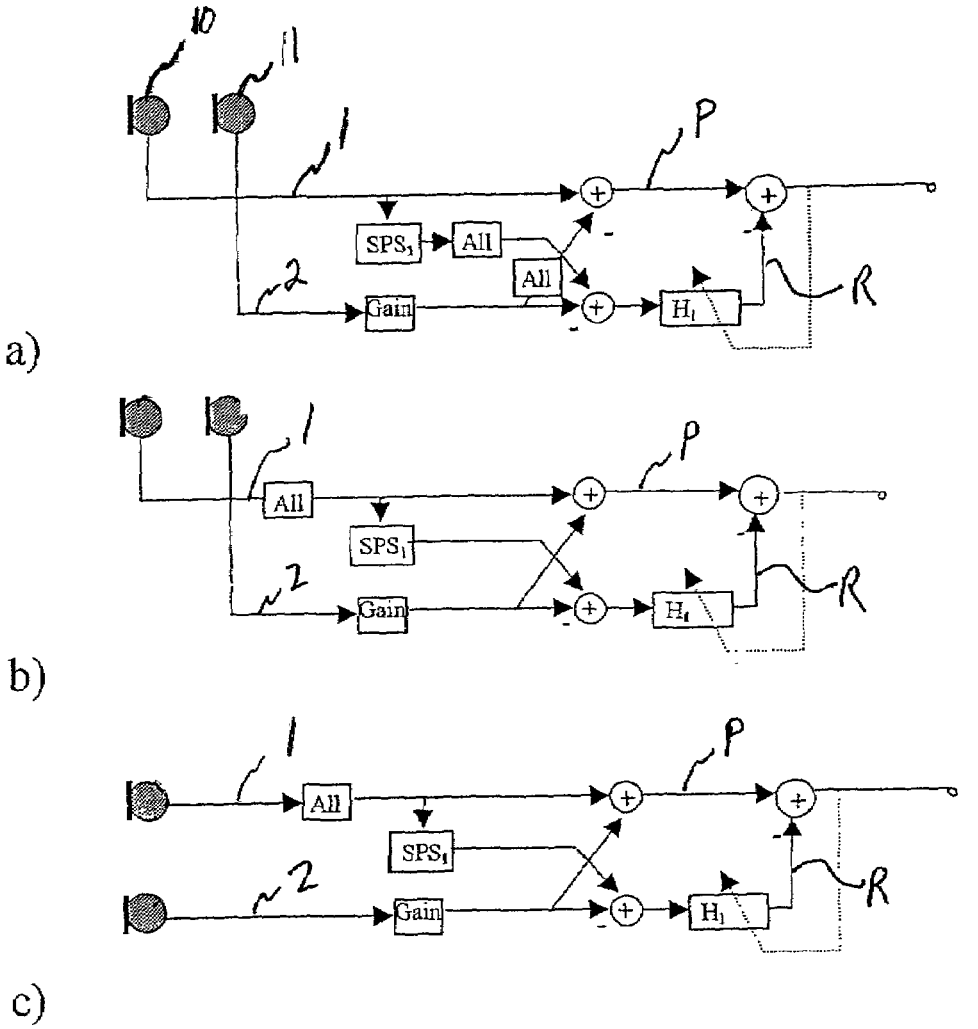
In FIGS. 4 and 5, the present invention will be explained in greater detail in the light of exemplary embodiments with reference to schematic drawings.

FIG. 4 shows 3 block diagrams with unilateral spectral subtraction for the reference input. The microphones 10, 11 are oriented to receive useful signals from the left in the figures.

In FIG. 4*a*, a primary signal P of the beam former (for example, a speech signal) is created using a differential array DA for channels 1, 2 (see arrangement c in FIG. 3), the microphones 10, 11 receiving the useful signals, for example a speech signal. FIGS. 4*b* and 4*c* show creating primary signal P as sum and difference array SD (see arrangements a and b in FIG. 3).

Figure 1:
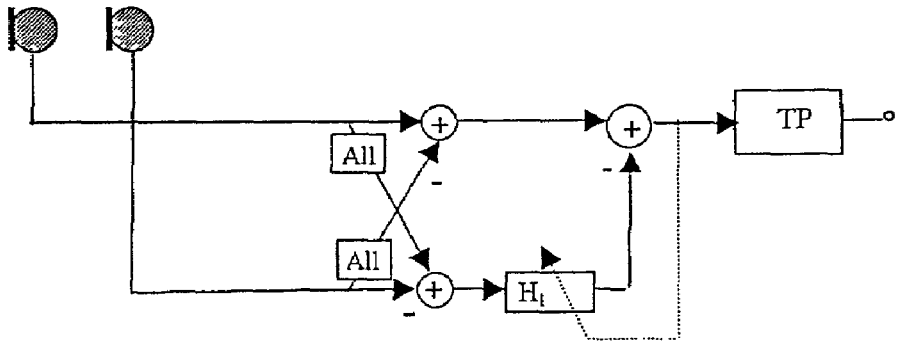
FIG. 1 shows a prior art adaptive arrangement for a beam former.
Figure 2:
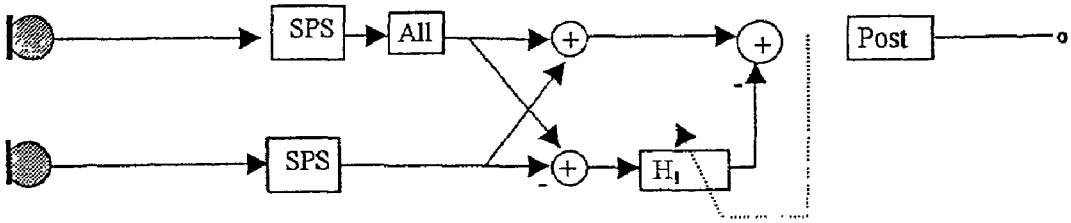
FIG. 2 shows a prior art arrangement for a broadside array composed of two spaced microphones, the two microphone signals being pre-processed by spectral subtraction (SPS).
Figure 3:
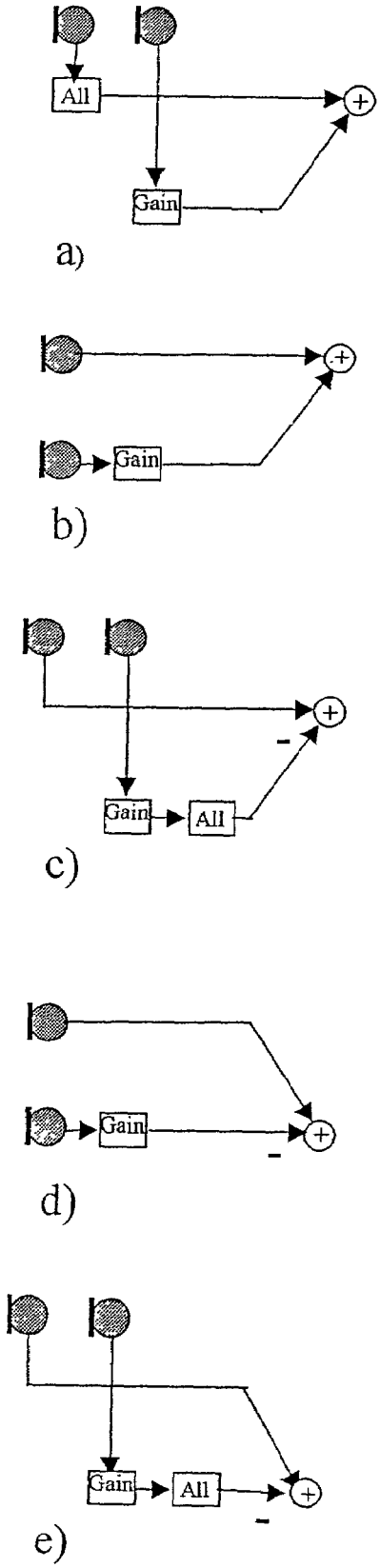
FIG. 3 is an overview of prior art microphone circuitry arrangement for the formation of the directivity characteristics for two microphones.

An interference reference input processes reference signal R with the additional extension of the unilateral spectral subtraction in differential form according to arrangements d and e in FIG. 3. The difference of the useful signal in channel 2 and the interference-suppressed useful signal from channel 1 is applied to adaptive filter H1. Adaptive filter H1 is adapted in the time domain or, in an equivalent form, in the frequency domain using the LMS algorithm. Subsequently, filtered interference reference signal R is subtracted from primary signal P.

Figure 5:
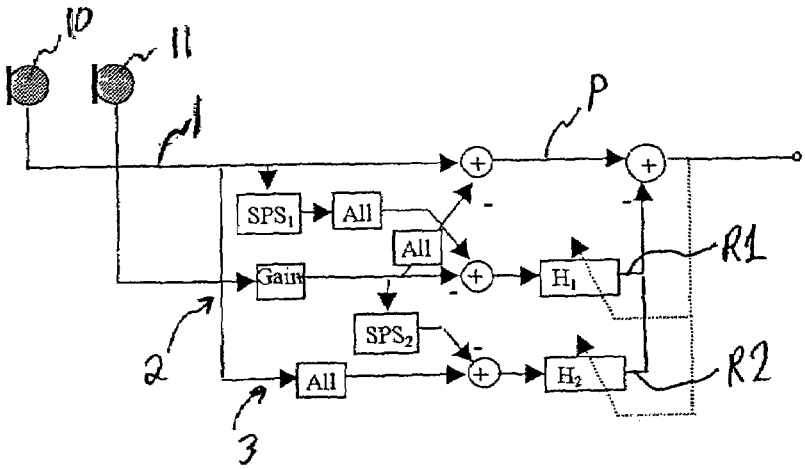

A further embodiment of the present invention according to FIG. 5 is to carry out unilateral spectral subtraction '$SPS_1$' once on channel 1 for the useful signal to thereby produce a first reference signal R1 together with the useful signal in channel 2. At a second time, unilateral subtraction '$SPS_2$' is carried out on the useful signal of channel 2 to produce a second reference signal R2 together with the useful signal in channel 1. The result is a system including 2 reference signals which are subtracted from primary signal P. In the case of speech signals, the interference is recorded during the speech pauses in each case with the characteristic of the single microphones and, given speech activity, a null is produced for the speech signal.

According to the explanations on the block diagrams of FIG. 4, the modification with 2 reference inputs is used for the end fire microphone array or broadside array. FIG. 5 shows the block diagram for the end fire array. The beam former is constituted by channel 1 for the speech signal and two reference channels 2, 3. Each reference input is filtered by an adaptive filter $H_1$ or $H_2$, respectively. The filter compensation is accomplished using a multi-channel LMS algorithm.

If more than 2 input signals are available, then a unilateral spectral subtraction is carried out in the described way through combination of two inputs at a time to obtain a reference signal. If, for instance, a broadside array including 3 microphones is assumed, 6 combinations follow for the formation of pairs. If, for each pair, allowance is made for the unilateral spectral subtraction to be optionally carried out on one channel or the other, then the number of combinations and, consequently, the number of reference channels is doubled. When working with an array including a plurality of microphones, one uses a limited number out of the possible combinations.

The present invention is not limited to the recording of the useful signals via microphones but also permits the use of reception systems as, for example, antennas. Useful signals can be any kind of acoustic or electric signals, and as defined herein are signals desired to be processed.

What is claimed is:

1. A noise reduction method in which a reference signal of the interference is produced for multi-channel interference compensation systems, the method comprising the steps of:

reducing interference of a useful signal in a first channel via a spectral subtraction so as to define a reduced-interference signal, the useful signal also being carried in a second channel;

forming an interference reference signal by subtracting the reduced-interference signal from the useful signal in the second channel;

applying the interference reference signal to an adaptive filter so as to define a first reference signal connecting the first channel and the second channel in an array so as to form a primary signal, the array being one of a differential array and a sum-and-difference array;

performing a further spectral subtraction on the useful signal of the second channel so as to define a spectral subtracted signal;

forming a second reference signal as a function of the useful signal from the first channel and the spectral subtracted signal, the second reference signal being applied to a second adaptive filter in a third channel, and subtracting the first and second reference signals from the primary signal.

2. The method as recited in claim 1, wherein the array is a differential array.

3. The method as recited in claim 1, wherein the array is a sum and difference array.

4. The method as recited in claim 1, wherein the filter is adapted in the time domain or in the frequency domain using a least mean squares algorithm.

5. The method as recited in claim 1, wherein the useful signal is recorded by microphones.

6. The method as recited in claim 1, wherein the useful signal is a speech signal.

7. The method as recited in claim 1, further comprising continuously adjusting the spectral subtraction as a function of a parameter.

8. The method as recited in claim 7, wherein the parameter is generated as the minimum value of a filter coefficient of the spectral subtraction.

9. The method as recited in claim 1, wherein in the case of more than two input signals, a spectral subtraction for producing the interference reference signal is carried out through combination of two inputs at a time.

* * * * *